United States Patent [19]

Coppa

[11] 4,142,321

[45] Mar. 6, 1979

[54] THREE-DIMENSIONAL FOLDED CHAIN STRUCTURES

[76] Inventor: Anthony P. Coppa, 748 S. Highland Ave., Merion, Pa. 19066

[21] Appl. No.: 733,221

[22] Filed: Oct. 18, 1976

[51] Int. Cl.[2] ..... A63H 33/16

[52] U.S. Cl. ..... 46/1 L; 35/72; 46/35

[58] Field of Search ..... 46/1 L, 35, 36, 1 R; 52/86; 161/4; 35/92

[56] References Cited

U.S. PATENT DOCUMENTS

| | | | |
|---|---|---|---|
| 137,075 | 3/1873 | Harrington | 35/72 |
| 1,997,022 | 4/1935 | Stalker | 46/1 L |
| 2,883,195 | 4/1959 | Rogers et al. | 46/1 L |
| 3,234,682 | 2/1966 | Frankl | 46/24 |
| 3,302,321 | 2/1967 | Walker | 46/1 L |
| 3,659,360 | 5/1972 | Zeischegg | 35/72 |
| 3,831,503 | 8/1974 | Tranquilitsky | 46/1 L |
| 3,894,352 | 7/1975 | Hooker | 46/1 L |

*Primary Examiner*—Louis G. Mancene
*Assistant Examiner*—Robert F. Cutting
*Attorney, Agent, or Firm*—Morton C. Jacobs

[57] ABSTRACT

Structures which have a wide variety of applications including that of educational toys are formed of chains of hinged three-dimensional units such as tetrahedra. The chains may be formed by folding a sheet of material.

23 Claims, 20 Drawing Figures

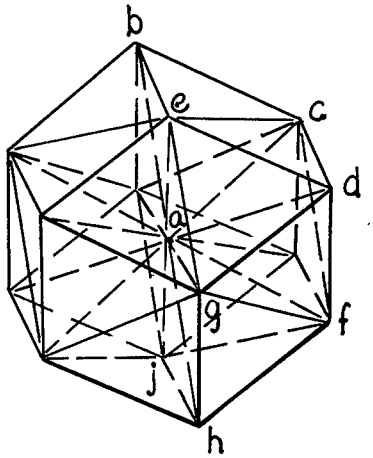
FIG. 9
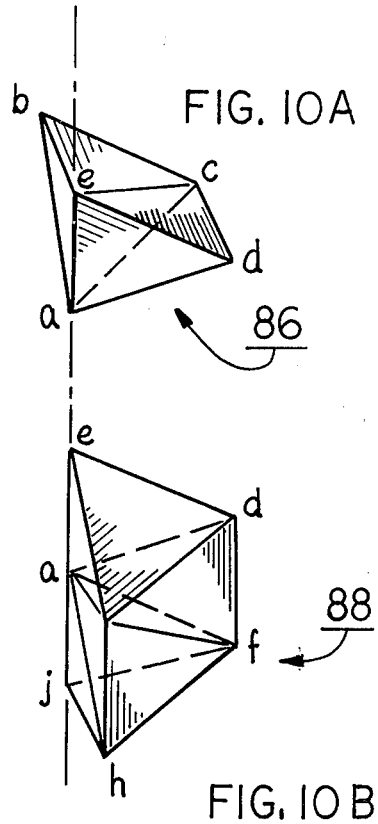
FIG. 10A
FIG. 10B
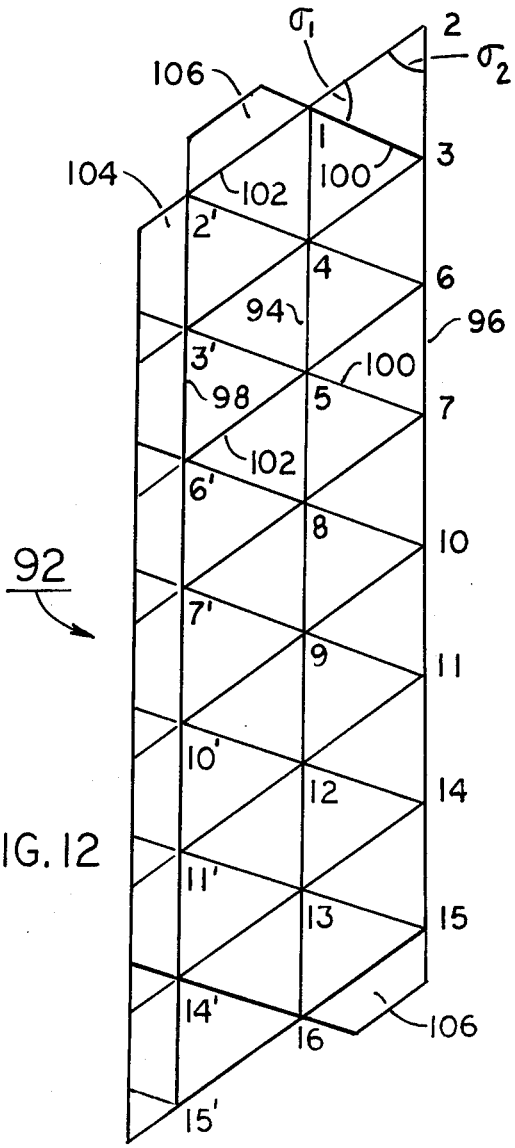
FIG. 12
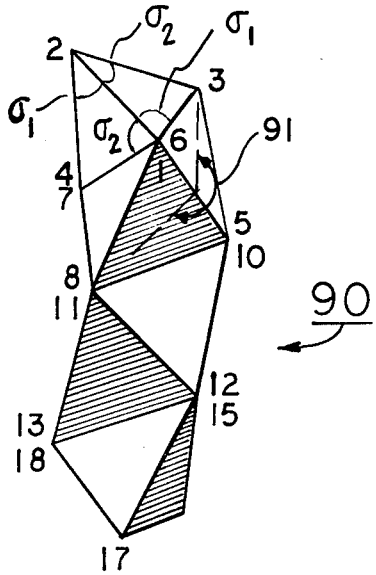
FIG. 11

THREE-DIMENSIONAL FOLDED CHAIN STRUCTURES

BACKGROUND OF THE INVENTION

This invention relates to structures and particularly to structures formed by folding a chain of three-dimensional hinged units, which chain may itself be formed by folding a sheet of material.

Applicant has discovered that by suitably hinging three-dimensional units into chains, more complex structures of substantial rigidity can be formed therefrom. Applicant has also discovered that such chains can be constructed by folding sheets of various types of materials. While the art of foldable structures from sheet material has developed somewhat, see U.S. Pat. No. 3,302,321, applicant, it is believed, is the first to form the aforementioned chains and the rigid structures therefrom.

SUMMARY OF THE INVENTION

It is among the objects of this invention to provide a new and improved structural unit.

Another object is to provide a new and improved foldable chain.

Another object is to provide a new and improved foldable blank for forming chain structures.

In accordance with embodiments of this invention, three-dimensional structural units are connected along hinges that are mutually shared by the edges of adjacent units. The units may be similar as well as dissimilar and equal as well as unequal. These configurations are flexible due to the action of the hinges that are transverse to the axis of the chain. But, due to nesting properties possessed by the structural units, they are readily transformed into rigid configurations by turning such units about their hinges so that surfaces of these units come in contact whereby the units are assembled in a packing relation. In order to retain such rigidity the structural units must be fastened together in their packed configuration.

In accordance with a feature of this invention, a structure is formed of a chain of three-dimensional enclosed units; each two adjacent ones of the units in the chain are connected by a hinge. The axis of said hinge is transverse to that of the chain; and at each vertex of the chain, the face angles about said vertex sum substantially to 360°.

In accordance with another feature of this invention, a folded rigid structure is formed of a chain of three-dimensional units having adjacent units hinged generally along common linear edges, and folded at those hinge edges with adjacent faces in contact.

Also in accordance with this invention, a blank of sheet material for forming a chain of three-dimensional units is characterized by a first set of parallel spaced fold lines formed for folding in one direction in said sheet, a second set of spaced fold lines formed for folding in the opposite direction in said sheet extending transversely to said first lines, and intersecting them at junctions, and at least one third line formed for folding in said opposite direction in said material and intersecting said first and second lines at said junctions. A chain of three-dimensional units is formed by folding the sheet along the fold lines with the hinged connections of the three-dimensional units in the chain being along the first lines.

Applications of the disclosed invention may be as educational devices and toys, art forms, and structural panels, columns and enclosures. The hinged units may be assembled in various prismatic and nonprismatic shapes, the assemblages of which result in unique constructions and structures. Constructions made according to the present invention may range in sizes from many feet as in panels or columns to several inches as in a toy, as well as in a wide variety of shapes and forms. As will be described, such constructions represent superior, interesting, educational, ornamental or structural characteristics and may have high rigidity per unit weight and be suitable for automated fabrication.

BRIEF DESCRIPTION OF THE DRAWING

The foregoing and other objects of this invention, the various features thereof, as well as the invention itself, will be more fully understood from the following description, when read together with the accompanying drawing in which:

FIG. 9 is a perspective view of a dodecahedron embodying this invention and folded from chains similar to FIG. 1;

FIGS. 10A and 10B are rhombic plates folded from chains which may be used to form the structure of FIG. 9;

FIG. 11 is a perspective view of another form of structure folded from a chain;

FIG. 12 is a face view of a sheet embodying this invention with a fold-line pattern used to construct one form of the chain of FIG. 1 or that used for the folded structure of FIG. 11;

In the drawing corresponding parts are referenced throughout by similar numerals.

DESCRIPTION OF A PREFERRED EMBODIMENT

Figure 1:
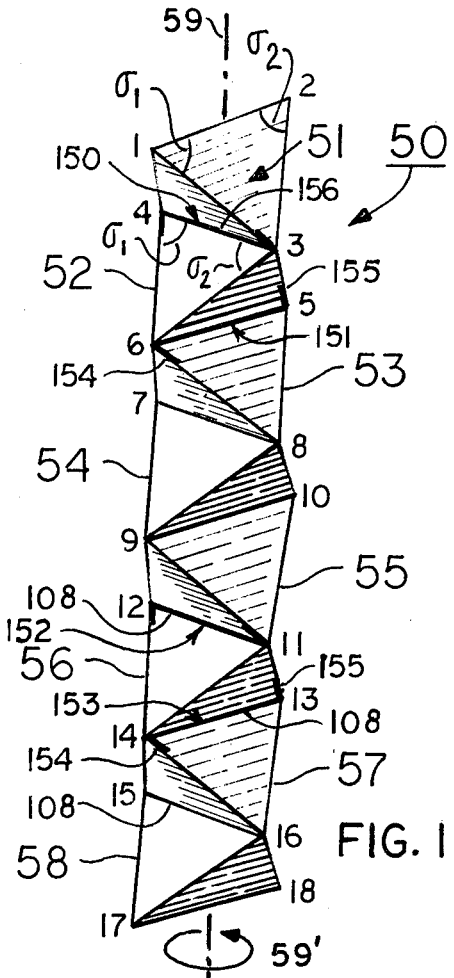
FIG. 1 is a perspective view of a chain of hinged three-dimensional units embodying this invention.

Many different chain structures are embodied in the present invention and various forms of these are described in connection with the drawing. In the form shown in FIG. 1, a series of equal tetrahedral units are hingedly connected in a chain 50. Eight tetrahedra 51, 52, 53, . . . 58 in chain 50 have their respective vertices identified by the numerals 1, 2, 3, 4; 3, 4, 5, 6; 5, 6, 7, 8; . . . 15, 16, 17, 18. These tetrahedra are hinged together along adjacent line segments or edges 4–3, 6–5, 7–8, . . . 15–16. Chain flexibility results from rotations of these units 51 to 58 about the associated hinge lines 4–3 through 15–16. Due to the fact that the hinged edges do not all lie in one plane (actually they are successively skew) such rotations may displace the units (and their hinged edges) in many directions. Not all structures covered by the present invention embody noncoplanar hinge lines. Certain types involve only coplanar hinges (as will be described later, FIGS. 14 and 16), and rotations of structural units about the hinges confine them to remain in a parallel relation. Certain other types involve both coplanar and noncoplanar hinges.

The three-dimensional character of the chain structure and, more important, that of the folded configurations resulting therefrom are determined by the shape of the faces (e.g., triangles, trapezoids, and other polygons — planar and curved) that comprise each structural unit. These facts are in turn determined by their base angles, which are designated by $\sigma_1$ and $\sigma_2$ in the triangular faces of FIG. 1, such as ∠ 312 and ∠ 321 of unit 51, and ∠ 643 and ∠ 436 of unit 52 which are adjacent to the hinged edges. These angles may be equal, as for isosceles faces, or unequal. The face elements may be triangular in shape, as in FIG. 1, or trapezoidal as in FIG. 14 or of other polygonal shapes as in FIG. 16.

When a flexible chain structure built in accordance with one aspect of this invention is packed in the proper manner, it is transformed into an essentially rigid structure whose shape depends on the base angles $\sigma$. The proper manner of packing for the structure of FIG. 1 is to rotate unit 51 (vertices 1, 2, 3, 4) about hinged edge 3–4 until vertex 1 is brought into coincidence with vertex 6 of unit 52 (vertices 3, 4, 5, 6). Then that assembly of units 51 and 52 is rotated about hinge edge 5–6 until vertices 3 and 8 are brought into coincidence. Then the assembly of units 51, 52 and 53 is rotated about hinged edge 7–8 until vertices 5 and 10 are brought into coincidence; and so on. This produces a structure such as the prism structure 60 shown in FIG. 2. This rotating process is equivalent to holding the top unit 51 fixed with a twist rotation of the lower units 52–58 about the central axis 59 of the chain relative to the upper unit 51 of the chain, in the direction of the arrow 59′ in FIG. 1. A similar structure, but having a torsionally reversed geometry may be produced by a similar but, oppositely directed twist (see FIG. 3).

In assembling the units by machine, the twisting operation would preferably be performed in the manner described above; that is, each unassembled unit is successively rotated and assembled into packing relation with the previously assembled adjacent units. Manual assembly (for example, when used as a toy) may be performed in the same fashion, or alternatively in reverse relation with the assembled units rotated into packing relation with the successive unassembled units.

Where both base angles of the triangular faces are approximately equal to the arc tangent $\sqrt{2}$, which angle $\sigma_p$ is 54°–44′–0.1″, a singularly important structure results, for the tetrahedral units are space filling and fold into prisms. Where the base angle is $\sigma_p$, the prism forming angle, and the chain is twisted in the above-described manner, a triangular prism 60 (FIG. 2) or 60′ (FIG. 3) having an equilateral triangular cross-section is produced. This prism structure 60 shown in FIG. 2, has the positions of the vertex points and tetrahedra of the original chain shown in the transformed structure. That is, vertex points 1 and 6 are substantially coincident, as are vertices 3 and 8; 7 and 12, etc. The triangular prism structure is further illustrated in FIGS. 3, 4 and 5 which are, respectively, top, side and end elevations of a similar prism 60′ resulting from a twist of the top tetrahedral unit 51 of chain 50 (FIG. 1) in the opposite direction relative to the remainder of the chain (i.e., opposite to arrow 59′). Due to the twist in FIG. 3 being the reverse of that of FIG. 2, the vertex points in coincidence are different. The twist in FIG. 3 proceeds from the left towards the right. The various tetrahedral units are identified in their respective positions by the vertex numbers 1–18 inclusive which also correspond to those numbers in FIG. 1.

Figure 3:
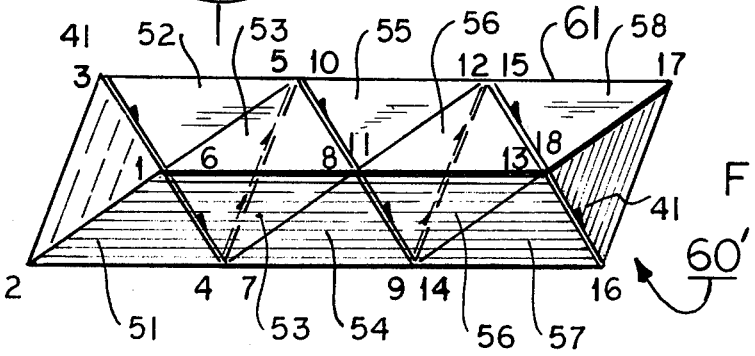
FIG. 3 is a plan view of a prismatic structure similar to FIG. 2 but folded from the chain of FIG. 1 in a different fashion.

In FIG. 3, the lines may be more easily understood by reference to the chain of tetrahedra of FIG. 1 and the correspondingly numbered lines; the numbering of each line being by way of the vertices of the line endpoints. The edges 2–3, 3–5, 10–12, 15–17, . . . 4–2 which form the perimeter 61 of the parallelogram base of the prism 60′ as viewed in FIG. 3 are drawn as single lines. In addition, the hinged edges 5–6, 7–8 11–12, 13–14 (and the edges 1–2 and 17–18 at the ends of the chain) are also drawn as single lines (hinged edges 3–4, 9–10 and 15–16 are hidden in FIG. 3 and not shown). The other edges of the tetrahedra in FIG. 3 are drawn as double lines: The latter are the nonhinged edges of three adjacent tetrahedra that are wound into substantial coincidence in the packed relation of FIG. 3 (except at each end of the prism where only the two tetrahedra at the corresponding end of the chain are packed with two edges in coincidence). These double-line segments represent the following sets of substantially coincident edges: 3–1, 3–6; 1–4, 4–6, 6–7; 4–5, 5–7, 7–10 (shown in broken lines to indicate their location on the hidden prism face of FIG. 3); 5–8, 8–10, 10–11; 8–9, 9–11, 11–14; 9–12, 12–14, 14–15 (similarly shown in broken lines); 12–13, 13–15, 15–18; 13–16, 16–18.

Figure 2:
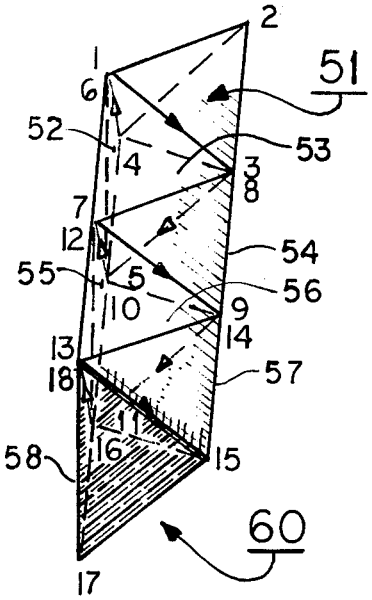
FIG. 2 is a perspective view of a prismatic structure embodying this invention and formed by folding the chain of FIG. 1.

Arrow heads 41 along these double lines indicate the sense of winding of the helix inherent in the structure. It is along this helix (really a linearly segmented helix) that the successive tetrahedra of the original chain wind. This helix is termed the principal helix of the structure. It is left-handed when assembled as shown in FIG. 2 with the twist rotation in the direction of arrow 59′ (FIG. 1), and right-handed with the opposite twist rotation as shown in FIG. 3. The arrow head indicators show the direction along which the principal helix progresses in the prism.

In FIG. 2, the helix starts at vertex 4, proceeds to vertex pair 1–6 and goes to vertex pair 3–8, as shown by the arrowheads; thence to pair 5–10; thence to 7–12; thence to pair 9–14; thence to pair 11–16; to pair 13–18; and finally to vertex 15. The resulting structure is a uniform triangular prism of equilateral triangular cross-section and having oblique and beveled ends. The end view of FIG. 5, an orthogonal projection, also corresponds to a cross-sectional view of the prism. The ends may be beveled toward each other as shown in FIGS. 2 and 3 (or beveled parallel to each other by adding one tetrahedral unit to the end, not shown).

Where the faces of the tetrahedral units are joined or fastened together (e.g., by bonding the adjacent faces) the prism structure is geometrically rigid and has excellent structural characteristics. This rigidity is due to its tetrahedral composition which confers axial, torsional, and flexural rigidity. In addition, the resulting structure is internally compartmented. These properties contribute significant utilitarian values to the structure.

Figure 4:
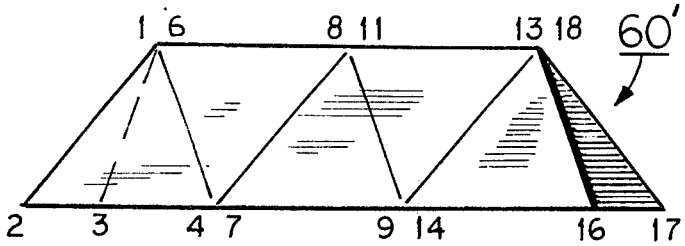
FIG. 4 is a side view of the structure of FIG. 3.
Figure 5:
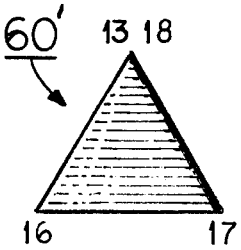
FIG. 5 is an end of the structure of FIG. 3.
Figure 6:
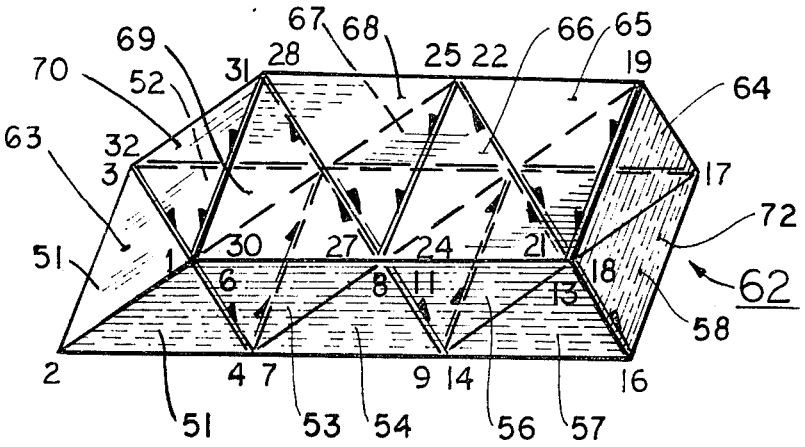
FIG. 6 is a perspective view of another prismatic structure embodying this invention and folded from a chain similar to FIG. 1 but longer and corresponding to a juxtaposition of two prisms like that of FIG. 3.

FIG. 6 is a top view of the prism 62 based on a chain similar to but longer than that which produces the triangular prism of FIGS. 3–5. An additional seven tetrahedra 64–70 are used in this chain and are connected in sequence from tetrahedron 58. This prismatic structure of FIG. 6 has a rhombic end face 63 (and cross-section) as shown in FIG. 6, and is produced by continuing the chain twisting process by doubling back on the hinge 17–18 at the right-end face 72 of the triangular prism and returning toward the left-end face 63 where vertices 1 and 3 at left-end face 63 are respectively juxtaposed with vertices 30 and 32 (of the extended chain, using an extension of the sequential numbering scheme of FIG. 1). When doubling back, the direction of mechanical twist is reversed in order to achieve this prism 62 of rhombic cross-section. The arrowheads in FIG. 6 indicate how the helical winding process progresses; this winding reverses at the point of doubling back. That is, in FIG. 6, the triangular-prism portion of tetrahedra 51–58 (vertices 1–18) has a right-handed helical winding (the same as in FIG. 3), while the triangular-prism portion of tetrahedra 64–70 (vertices 17–32) has a left-handed helical winding, as shown by arrowheads in FIG. 6. This rhombic prism can also be made by combining and juxtaposing together two separate triangular prisms (one like FIG. 2 and one like FIG. 3).

Figure 7:
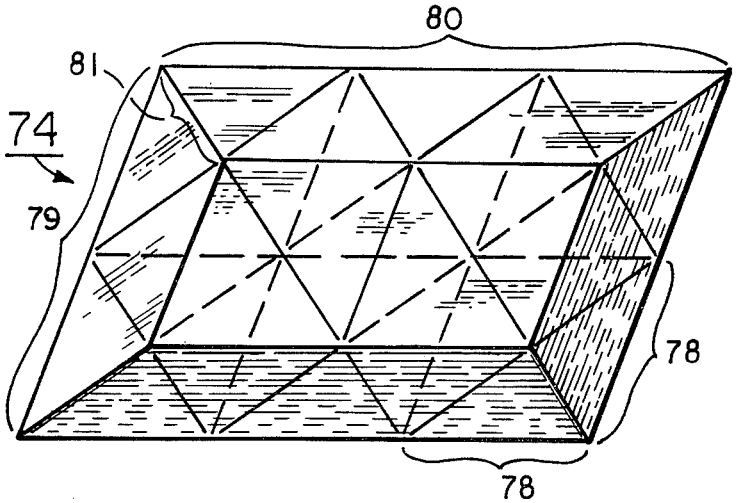
FIG. 7 is a perspective view of another prismatic structure embodying this invention and corresponding to a juxtaposition of three prisms like that of FIG. 3.
Figure 8:
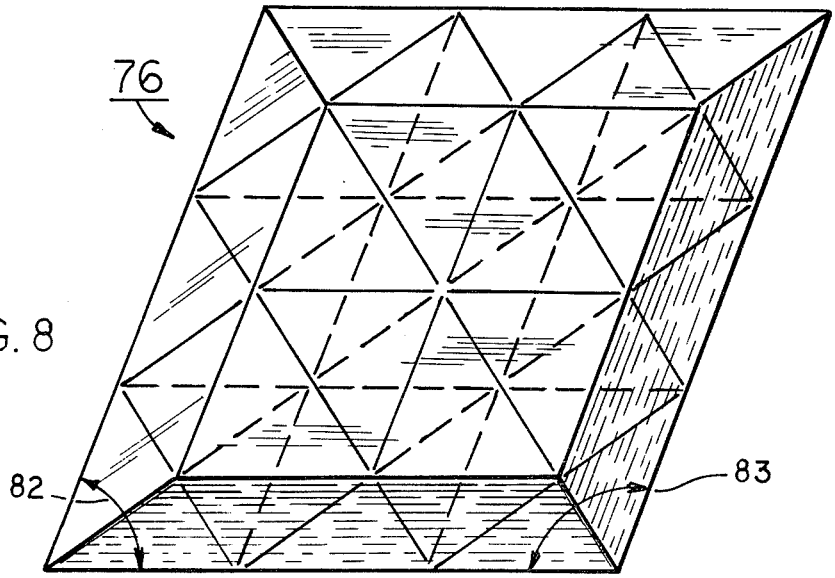
FIG. 8 is a perspective view of another prismatic structure embodying this invention and corresponding to a juxtaposition of five prisms like that of FIG. 3.

By means of such winding procedures involving longer and longer chains, or combining separate triangular prisms in the manner indicated, many other structures can be produced. Examples of some are shown in FIGS. 7 and 8. In FIG. 7, the prism 74 is formed of three triangular prisms produced, for example, with two winding reversals; and, in FIG. 8, the prism 76 is formed of five triangular prisms produced with four-winding reversals. This process may be continued to any desired extent; any number of triangular prisms may be similarly juxtaposed. In this manner plate-like structures of any size may be constructed.

Such plate-like structures may be individually identified by the set of integers M, N and P ($1 \leqq P \leqq M$); M is the number of segments like 78 of FIG. 7 that make up the shorter edge 79 and N is the number in the longer edge 8 of the base perimeter of the structure, and P is the number of segments like 81 of FIG. 7 that comprise the elevation edge. Segments 78 and 81 of FIG. 7 correspond to non-hinged edges such as 5–8, 9–12 of FIG. 1. For example, in FIG. 3, M = 1, N = 3, P = 1; in FIG. 7, M = 2, N = 3 and P = 1; in FIG. 8, M = 3, N = 3, P = 1. These particular structures have opposite bevels in opposite pairs of edges and may be called symmetrically beveled.

Structures like that shown in FIG. 6 (M = 1,N = 3,P = 1) have bevels of mixed symmetry since one pair of lateral edges (long edges) have parallel bevels (antisymmetrical) whereas the short edges have symmetrical bevels. Similarly, rhombic plates having antisymmetrical bevels on all edges are called antisymmetrically beveled.

The total sum, S, of tetrahedra comprising rhombic plates designated by the integers M, N and P = 1 are given by the following formulas:

| | |
|---|---|
| Symmetrically Beveled: | $S_s = 6\,MN - 3\,(M + N) - 2$ |
| Antisymmetrically Beveled: | $S_{as} = 6MN$ |
| Mixed Symmetrically Beveled with larger edges of base having parallel bevels: | $S_{ms} = S_s + 3N - 2$ |
| and with shorter edges of base having parallel bevels: | $S_{ms} = S_s + 3M - 2$ |

Rhombic plates can be assembled into many different and complex structures, especially since the bevels at all edges are 60° (where the base angles of the tetrahedral units are $\sigma_p$) and their corner acute angles 82 and obtuse angles 83 are (referring to FIG. 8) respectively 70° - 31′ - 58″ and 109° - 28′ - 0.2″. These angles permit rhombic plates to mate and nest perfectly together. An example of a complex structure assembled from such nested plates is the solid rhombic dodecahedron 84 shown in FIG. 9. This may be constructed from a single chain having 24 tetrahedral units; or from 12 equal symmetrically beveled rhombic plates 86, M = 1, N = 1, P = 1) shown in FIG. 10A having two tetrahedral units each; or from six triangular prisms 88 of the type shown in FIG. 10B, each having four tetrahedral units. Such a construction from a single chain of 24 tetrahedral units requires the sequential formation of six prisms (FIG. 10B) and five winding reversals.

The two-unit plate 86 of FIG. 10A has sequentially numbered vertices *a* to *e* that correspond to the center point *a* and vertices *b* to *e* of the dodecahedron 84 of FIG. 9. Similarly, point *a* and vertices *d* to *j* of four-unit prism 88 of FIG. 10B correspond to those same-numbered points in FIG. 9. The plate 86 and prism 88 are drawn in relation to the centra axis *e-a-j* (shown as a broken like in FIGS. 10A and 10B) of the dodecahedron for assistance in viewing the aforementioned relationship.

Rhombic dodecahedra can be constructed from twelve equal symmetrically beveled plates of the designation (M, M, P); such dodecahedra may be designated as M, P dodecahedra. If P = M, the dodecahedron will be solid, like FIG. 9, in which M = N = P = 1. When P < M, the dodecahedron will be hollow, the hollow shape being equal to the outside of a rhombic dodecahedron made up edges equal in length to M–P tetrahedral segments. For example, a dodecahedron comprised of 12 plates like 76 shown in FIG. 8 (M = N= 3, P = 1) will be hollow since P < M. The empty space will be exactly filled by a (2, 1) dodecahedron, i.e., one comprised of 12 plates (M = N = 2, P = 1).

Table 1 lists the number of constituent tetrahedra comprising symmetrically beveled rhombic plates (M = N, P = 1) and their corresponding hollow and solid dodecahedra for several values of M.

TABLE 1.

| M | NUMBER OF TETRAHEDRAL UNITS (t. u.) PLATE | HOLLOW SHELL | SOLID BODY |
|---|---|---|---|
| | t.u. | t.u. | t.u. |
| 1 | 2 | — | 24 |
| 2 | 14 | 168 | 192 |
| 3 | 38 | 456 | 648 |
| 4 | 74 | 888 | 1536 |
| 5 | 122 | 1464 | 3000 |

Interesting and useful space enclosing structures can be constructed of assemblies of such plates, such as those designated by either M = N, P < M or M ≠ N, P < M and of the symmetrical, antisymmetrical, and mixed symmetrical beveled plates.

All of the structures described with respect to FIGS. 2 to 10 as well as many others are derived from flexible chains based on base angles of $\sigma_p$, the critical prism-forming angle. In the following description, structures are derived from flexible chains whose base angles are not equal to $\sigma_p$. A practically unlimited variety of flexible chain structures of the type shown in FIG. 1 can also be constructed with equal base angles $\sigma=\sigma_1=\sigma_2$, but $\sigma \neq \sigma_p$, and having any value other than $\sigma_p$ in the range $45° < \sigma < 90°$. When chains such as that of FIG. 1 are constructed from angles $\sigma$ that are different from $\sigma_p$ and are folded (or twisted) into a rigid form 90 (shown in FIG. 11), the resulting rigid structure is related to that produced by folding the chain of FIG. 1 into the prism of FIG. 3. In FIG. 11 the continuum of the non-hinged edges defined by the successive pairs of vertices such as (3, 5), (10, 12), and (15, 17) (or of the edges (6, 8) and (11, 13)) do not lie on straight lines (as do the corresponding continuum of segments in the FIG. 3 structure). The assemblage of each of these two sets of segments of crystalline structure 90 can be described as slightly helical. Hence, the structure resulting from this folding is a twisted crystal. Such structures based on $\sigma < \sigma_p$ are characterized by an overall twist of such sets of edges that is left-handed for a twist rotation in the direction of the arrow 59' in FIG. 1, and right-handed for structures based on angles $\sigma > \sigma_p$, for the same direction of twist rotation. For structures such as that shown in FIG. 3, based on $\sigma = \sigma_p$, set of triangular faces such as (3, 6, 5), (5, 6, 8), (10, 11, 12), (11, 12, 13) and (15, 17, 18) of FIG. 3 are co-planar, and hence the dihedral angles at lines of intersection, of adjacent ones of these faces such as (6, 5), (11, 12) and (17, 18) etc., are equal to 180°. Structures based on $\sigma < \sigma_p$ will have dihedral angles <180° and those based on $\sigma > \sigma_p$ will have dihedral angles >180°, the dihedral angles being measured at the exterior of the structure. The rigid structure of FIG. 11 is based on angles $\sigma > \sigma_p$, and the dihedral angle 91 is >180°. Unlike rigid prisms corresponding to $\sigma = \sigma_p$, crystalline structures having $\sigma \neq \sigma_p$ will not pack together in larger assemblies in a similarly exact manner as prisms into plates. Such larger assemblies will in general be open networks of rigid twisted structures of the form of structure 90 (FIG. 11) but may possess regions where some degree of nesting among adjacent elements exists.

All of the foregoing structures can be fabricated from a flat sheet 92 (FIG. 12) of material by means of a simple folding process. The sheet 92 contains a pattern of fold lines (or edges) 94, 96, 98, 100, 102. These lines intersect at points that are numbered to correspond to the vertices of the chain structure of FIG. 1. Lines 96 and 98 are longitudinal edges of the sheet. A first set of parallel fold lines 102 are transverse to the longitudinal lines 96 and 98 and become hinges in the chain. A third fold line 94, centrally located midway between fold lines 96 and 98, containing the point 1, 4, 5, 8, 9, 12, 13 and 16 is parallel to the long edge 96 of sheet 92, which contains the points 2, 3, 6, 7, 10, 11, 14 and 15, and parallel to the fold line 98 which contains the corresponding points 2', 3', 6', 7', 10', 11', 14' and 15'. The first set of parallel fold lines 102 intersect a second set of parallel fold lines 100. The equally spaced second fold lines 100 pass through the following groups of points (1, 3), (2', 4, 6), (3', 5, 7), (6', 8, 10), etc. The first set of equally spaced parallel fold lines 102 consists of fold lines that are parallel to the transverse edges of the sheet 92 and pass through the points (2, 1, 2'), (3, 4, 3'), (6, 5, 6'), (7, 8, 7'), etc. The two sets of fold lines 100 and 102 intersect each other in the acute angle $\sigma_1$; and the fold lines 102 are inclined to the edges and or fold lines 94, 96, 98 of the sheet by the acute angle $\sigma_2$. For the general pattern based on angles $\sigma_1 \neq \sigma_2$ (discussed further below) the equal spacing of the first set of parallel fold lines 102 is different from the equal spacing of the second set of parallel fold lines 100. For patterns based on $\sigma_1 = \sigma_2$, the spacing between all fold lines 100 and 102 is identical to form the equal sides of isosceles triangles. In addition to the fold pattern, the sheet may contain tab portions 104 and 106, which themselves also contain fold lines that are a continuation of the fold pattern as shown in FIG. 12.

To form the chain structure of FIG. 1, folds are made along the third or central line 94 (and the line 98 parallel to it adjacent to the long tab 104, if there is a tab); and the second set of parallel lines 100 are also folded. All of these folds should be in the same direction; i.e., they should all be concave or convex — to form the chain of FIG. 1, the folds should be convex for the top face of the sheet to become the external faces of the tetrahedra. Folds are made in the opposite direction along the first set of parallel lines 102. The sheet is transformed into the chain structure of FIG. 1 by bringing the following points into contact with each other: 2 and 2',3 and 3',6 and 6',7 and 7', etc. the lines 102 become the hinges 108 of FIG. 1. If the sheet contains no tab portions, a seam is made along the long edges and each of the end lateral edges 2 - 1 - 2', and 15 - 16 - 15' (the tabs 106 generally assist in holding the end edges). If tabs are present, they may be placed inside or outside the developed structure and fastened to the corresponding contact surface along the opposite long edge or short edges. A convenient means of effecting tab closures by means of pre-attached pressure sensitive adhesive areas on the tab portions or other adhesive tapes may be applied to effect non-tab closures.

Figure 13:
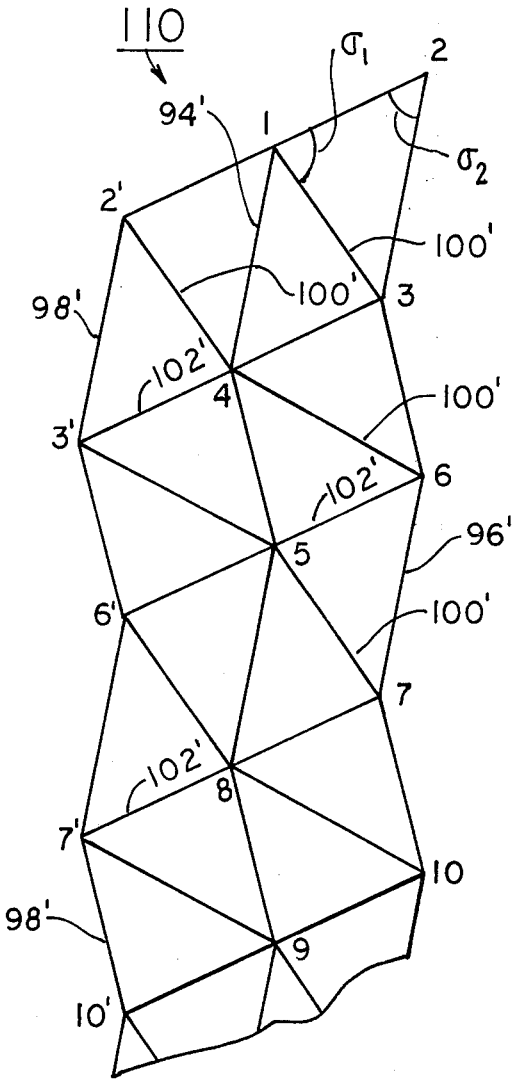
FIG. 13 is a face view of a fold-line sheet used to construct another form of the chain of FIG. 1.

Additional structures are derived from flexible chains 50 (FIG. 1) that are based on unequal values of base angles, i.e., $\sigma_1 \neq \sigma_2$. The same angles $\sigma_1$ and $\sigma_2$ repeat in each triangular face of the chain such that, referring to FIG. 12, $\sigma_1 = \angle$ 213 $= \angle$ 43'5 $= \angle$ 657 $= \angle$ 87'9, etc. $= \angle$ 134 $= \angle$ 3'56' $= \angle$ 578, etc.; $\sigma_2 = \angle$ 123 $= \angle$ 436 $= \angle$ 567 $= \angle$ 8,7,10, etc. $= \angle$ 2'3'4 $= \angle$ 3'6'5 $= \angle$ 6'7'8, etc. Where $\sigma_1 \neq \sigma_2$, the triangular faces in each tetrahedral unit are non-isosceles; due to the uniform spacing between fold lines, these faces are equal, over the range $90° < \sigma_1 + \sigma_2 < 180°$.

Where such chains are folded (twisted) through a process similar to that which transforms the structure of FIG. 1 to that of FIG. 2, the resulting rigid structure may be significantly different from that shown in FIG. 11 in that sets of vertices of adjacent tetrahedral units such as (1, 6), (4, 7), (5, 10), (8, 11), etc., may or may not be brought into coincidence. Such rigid structures that are based on unequal values of base angles, i.e., $\sigma_1 \neq \sigma_2$, and derived from a flat sheet pattern 92 (FIG. 12) do not have such vertices in coincidence. Corresponding structures based on unequal values of base angles and derived from a modified flat sheet pattern 110 of FIG. 13 do have such vertices in coincidence. Corresponding fold lines (or edges) in FIG. 13 are referenced by the same numerals as those in FIG. 12 with the addition of a prime (′). The first fold lines 102′ are straight lines; but the segments of the third fold line 94′ and the edges 96′, 98′ and of the second fold lines 100′ do not lie along straight lines. Instead, the second and third fold lines and the longitudinal edges bend at each intersection with the first fold lines 102′; the corresponding parts of the second fold lines 100′ are equispaced to form parallel lines.

Points in FIG. 13 such as 1 and 6, 2′ and 5, 4 and 7 lie along lines that are perpendicular to fold lines 102′. Line segments such as (1, 3), (3, 6), (2′, 4), (4, 5), etc. are equal to each other and line segments such as (1, 4), (4, 6), (2′,3′), and (3′, 5) are equal to each other. With these parameters of fold line pattern, a chain structure is formed that folds into a crystalline structure in which the above-noted sets of vertices are coincident notwithstanding that $\sigma_1 \neq \sigma_2$.

Figure 15:
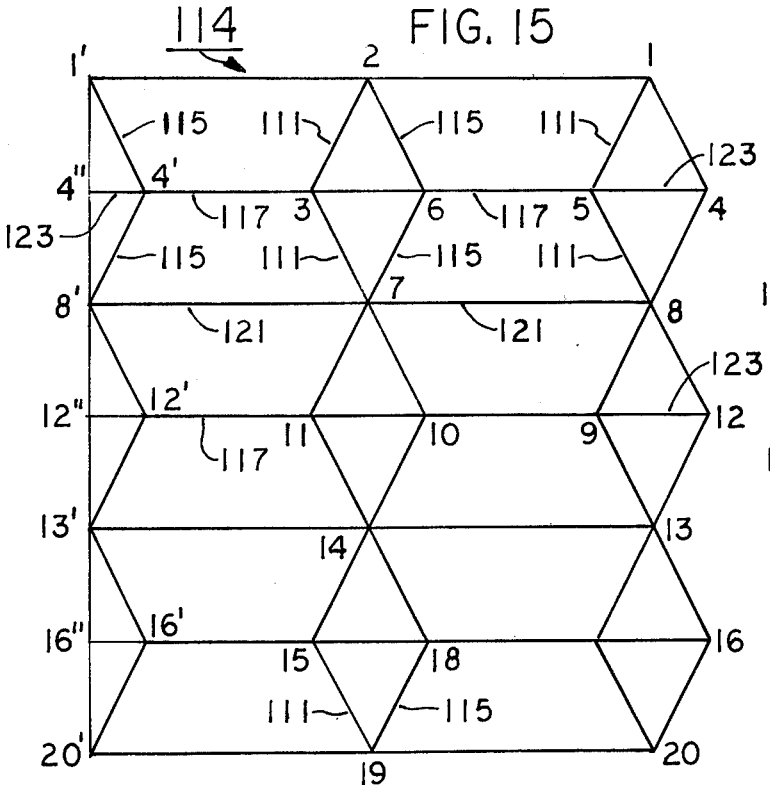
FIG. 15 is a face view of a fold-line sheet for constructing the chain of FIG. 14.
Figure 14:
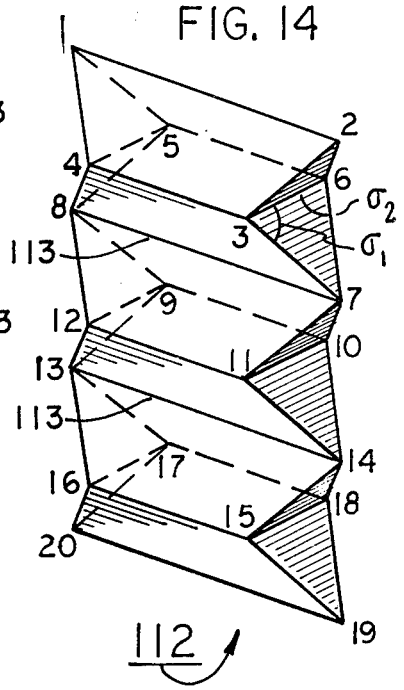
FIG. 14 is a perspective view of another chain embodying this invention.

Besides structures composed entirely of triangular-faced units, as all of the foregoing are, other structures embodied in the present invention may possess a mixture of other shaped faces, such as trapezoidal or rectangular, in the three-dimensional units of their basic chains. One such structure 112 is shown in FIG. 14, in which faces (1,2,3,4), (1,2,6,5,), (4,3,7,8), (5,6,7,8), etc. are trapezoidal. A set of triangular faces equal in number completes the surface form; these faces are (1,4,5), (2,3,6), (3,6,7) etc. In this structure, all hinges 113 are co-planar such as (1,2), (7,8), (13,14), and (19,20). It is evident that if segments such as (3,4), (5,6), (9,10), (11,12), etc. are reduced to zero length, the structure becomes equivalent to a tetrahedral chain structure of the type shown in FIG. 1. Hence, the size and form of the structure of FIG. 14 is completely specified by the base angles and the lengths of segments such as (4,5) and (3,6) in the triangular faces and the lengths of segments such as (3,4) and (5,6) in the trapezoidal faces. The base angles $\sigma_1$ and $\sigma_2$ may or may not be equal. The fold line pattern for producing the structure of FIG. 14 from a flat sheet 114 is shown in FIG. 15. The pattern proper is enclosed by the set of points 1, 4, 8, 12, 13, 16, 20, 19, 20′, 16′, 13′, 12′, 8′, 4′, 1′, and 2. The additional exterior portions which extend on the left to points 4″, 12″, 16″ are optional closure tabs. Folds in the same direction are made along all diagonal lines such as the second set of line segments 111 (which are parallel in that they are correspondingly equispaced) enclosed by the points (2,3), (3,7), (7,11), (1,5), (5,8), etc. the segments 115 that form the third fold line enclosed by the points (2,6), (6,7), (7,10), etc. and for patterns containing tabs (1′, 4′), (4′, 8′), etc. and the horizontal parallel line segments 117 enclosed by the points (4′,3), (6,5), (12′,11), etc. and in the opposite direction along all other lines such as the first set of parallel lines 121 (which become hinges 113) enclosed by the points (8,7), (7,8′), (13,14) (14,13′), etc. and segments 123 identified by the points (3,6), (5,4), (11,10), etc. and for patterns containing tabs along (4′,4″), (12′,12″), etc. A fourth set of parallel lines is composed of the collinear segments 117 and 123. The sheet 114 is transformed into the structure of FIG. 14 by bringing the following points into mutual contact: (1,1′), (4,4′), (8,8′), (12,12′), etc. Lines 121 become the hinges 113 and their folds are therefore concave. Lines 123 are also in concave folds, and the remaining lines are on convex folds. The tabs and/or closure seams are processed similarly to the fabrication procedure described above for FIG. 12.

Figure 16:
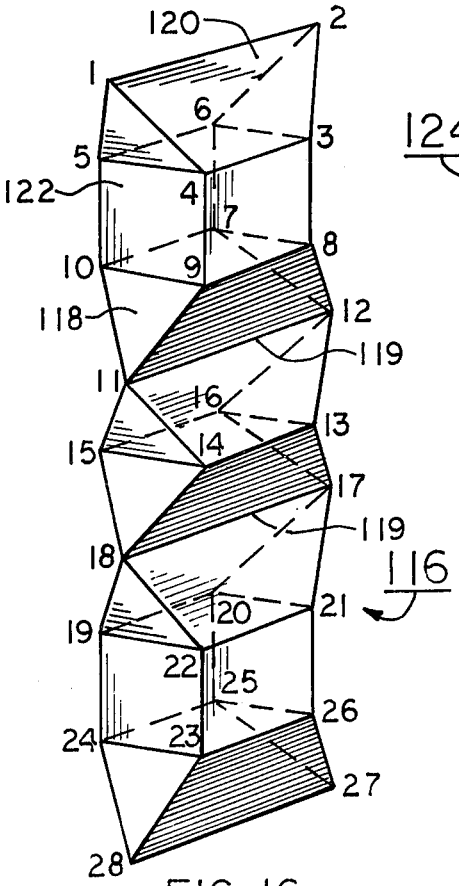
FIG. 16 is a perspective view of another chain embodying this invention.
Figure 17:
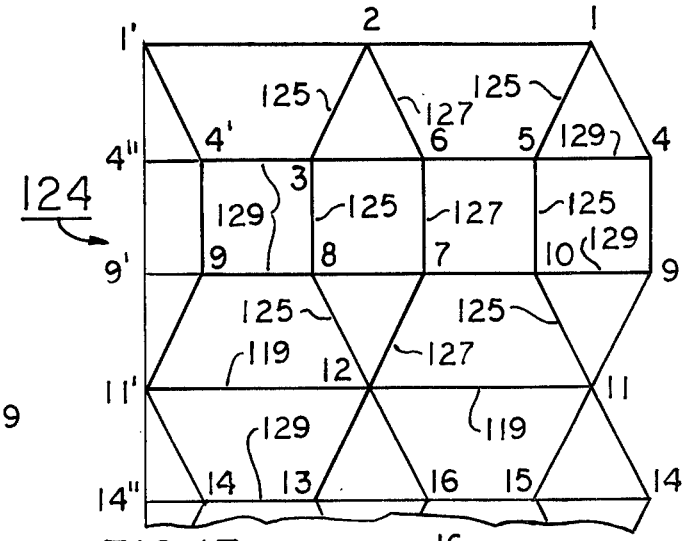
FIG. 17 is a face view of a fold-line sheet for constructing the chain of FIG. 16.

Another example of this type of structure composed of a mixture of different kinds of faces is shown in the chain 116 of FIG. 16, consisting of triangular, trapezoidal and square faces 118, 120 and 122, respectively, connected in a chain at hinges 119. The corresponding fold line pattern is shown in the sheet 124 of FIG. 17. The process of folding this chain 116 from the fold line pattern is similar to that described in FIG. 15; the first set of parallel lines 119 become hinges; the third fold line is composed of segments 127; the second set of fold lines includes segments 125; the fourth set includes lines 129.

Figure 18:
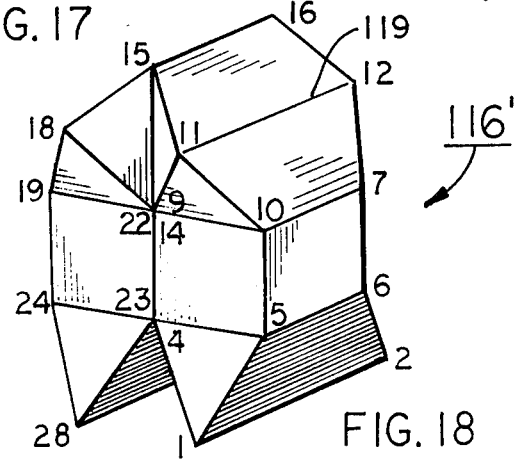
FIG. 18 is a perspective of a folded form of the chain of FIG. 16.

When the three-dimensional units comprising the chain structures of FIGS. 14 and 15 are rotated about their common coplanar hinge lines 113 and 119, respectively, such as segments (7,8) and (13,14) of FIG. 14, until adjacent units come into mutual contact and are suitably fastened together, rigid structures result. An example of such a rigid structure 116 is shown in FIG. 18 which corresponds to the chain structure 116 of FIG. 16. A useful property of the structure of FIG. 18 is that faces such as (7, 10, 11, 12) and (11, 12, 16, 15) are co-planar, a condition resulting from the presence of prismatic base angles, i.e., $\sigma = \sigma_p$, in the triangular faces. The co-planarity results from the dihedral angles at the hinges 119 being right angles; this is the same angular condition that exists at the hinges 108 in the chain of FIG. 1 which also produces the co-planar prismatic surfaces of FIGS. 2 and 3. This feature of co-planar hinge lines enhances the packing possibilities of the structure of FIG. 18. It will be apparent to those skilled in the art that many variations of the chain structures of FIGS. 14 and 16 embodying this invention may be formed. They may involve more complex three-dimensional units and feature co-planar or non-coplanar hinges throughout or a mixture of coplanar and non-coplanar hinges.

Figure 19:
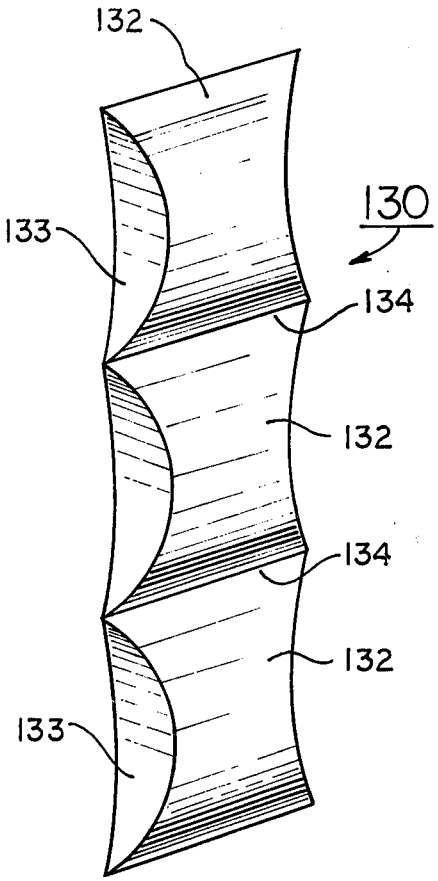
FIG. 19 is a perspective of another chain of three-dimensional units having curved surfaces embodying this invention.
Figure 21:
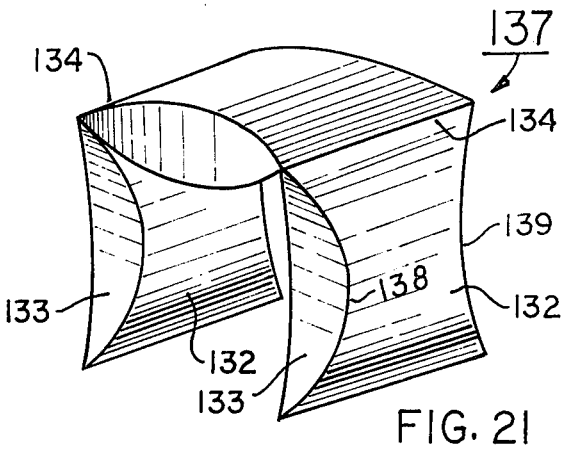
FIG. 21 is a perspective view of a folded form of the chain of FIG. 16.
Figure 20:
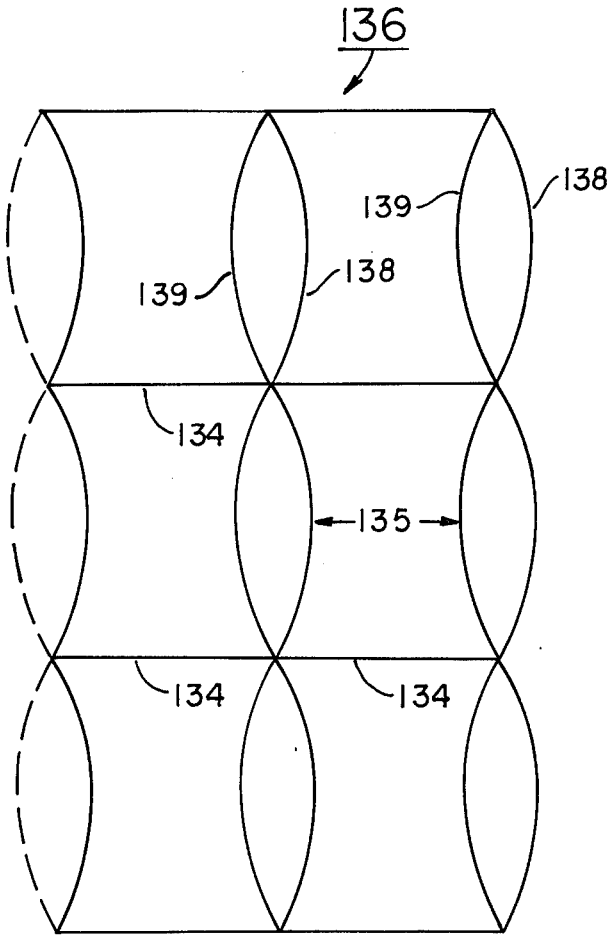
FIG. 20 is a face view of a fold-line sheet for constructing the chain of FIG. 19.

Chain structures disclosed in this invention may also be comprised of units made up of curved surfaces; chain 130 of FIG. 19 is an example. The curved faces 132 are formed in three-dimensional units connected at hinges 134 in a chain produced from a sheet 136 (FIG. 20) having a pattern of curved fold lines 138, 139. Each curved fold line is common to a convexly curved surface 132 situated on one side of it and a concavely curved surface 133 on the other. This characteristic is present wherever curved fold lines exist in these units. The first set of parallel straight lines 134 become hinges; the third fold line 138 is curved and located midway between the curved longitudinal edges); and the second set is formed of parallel curved fold lines 139, that is, corresponding parts of fold lines 139 are equispaced. Such chains 130 may be folded similarly to other chains described herein, i.e., by rotating adjacent units about their common hinges 134 to form a folded structure 137 (FIG. 21). The maximum hinge rotation is limited to the angle between the principal tangents to the adjacent curved surfaces at their common hinge in the position shown in FIG. 19; when folded as shown in FIG. 21, the adjacent units of the chain 130 have been rotated through the maximum rotation angle to bring their principal tangents into coincidence.

The type of unit depicted in FIG. 19 is related to the structure shown in FIG. 14. Curved unit structures related to those of FIG. 1 are also contemplated by the present invention. These are described as structures as in FIG. 19 with the minimum disstance 135 between each pair of opposite concave surfaces reduced to zero in all units. The curved fold lines may have the form of circular, parabolic, hyperbolic, or any generally smooth curve. The fold line may also be a mixture of curved and straight line segments.

A necessary characteristic of the chain structures folded from a planar sheet and embodying this invention is that at each vertex of the chain such as at points 3, 4, 5, 6, 7, 8, etc., in the structure of FIG. 1, the face angles which are adjacent to any such vertex sum substantially to 360°. Hence, the set of face angles (1,3,4), (1,3,2), (2,3,4), (4,3,5), (5,3,6) and (4,3,6) adjacent to vertex 3, and all similar sets of face angles, sum substantially to 360°. Similarly, in the other embodiments, the set of face angles at each vertex sum substantially to 360°: in the structure of FIG. 14, the set of face angles such as (2,3,4), (2,3,6), (6,3,7) and (7,3,4,) adjacent to chain vertex 3, or face angles (3,7,8) (3,7,6), (6,7,8), (8,7,10), (10,7,11) and (11,7,8) adjacent to vertex 7; and in the structure of FIG. 16 the set of face angles such as (5,4,1), (1,4,3), (3,4,9) and (9,4,5) adjacent to chain vertex 4, or face angles (9,11,12), (12,11,14), (14,11,15), (15,11,12), (10,11,12) and (9,11,10) adjacent to vertex 11. Similarly, in chain structures which have curved face elements such as that shown in FIG. 19, the set of angles between the tangents to the curved edges that bound the curved faces 133 at their common vertex and the angles formed by the same tangents and the common hinge 134 at the same vertex together sum substantially to 360°.

Fabrication of flexible chain structures such as those shown in FIGS. 1, 14, 16 and 19, etc., can be accomplished from long and relatively narrow sheet material by means of an automated or semi-automated machine process as well as by manual operations. Such an automated process may involve embossing the fold line pattern in the flat sheet either by means of embossing rolls or plates. Holes and other desired cut-outs may also be punched or die-cut as desired. Such holes are primarily useful in structures based on $\sigma = \sigma_p$ (e.g., those of FIGS. 3, 6, 7, 8 and 9) and are also useful in the others as well. Such holes can be so arranged that, when the resulting chain structure has been folded into a crystalline type form, the holes line up in a straight line. This is a useful feature since it permits installation of a rod, tube, cable, etc. through the interior of the structure. This is advantageous in a wall or ceiling structure and in educational toy or puzzle applications. Such holes can have any cross-section shapes, since making it in the generating sheet requires only a punching operation. Hence, installation of a rectangular duct or elliptical tube can be accommodated.

Colors, designs, or identifying numerals or other marks may also be conveniently applied to the sheet while still in the flat condition. Other additives such as bulk or sheet adhesive or reflective materials may also be applied. Such applications may be effected in a uniform manner over the entire sheet, but a unique feature of this invention is that such applications may be made on selected face elements within the fold pattern and not on others so as to obtain useful properties and functions. By such means, for example, the structure of FIG. 3 may be made to possess an entire exterior surface in one color and an entire internal surface in another color or coated with light reflective material. The unique feature embodied here is that any pattern of holes, colors, prints or reflected surfaces applied to the flat sheet (including both surfaces of the sheet) will be situated on the interior and exterior surfaces of the three-dimensional assemblage of the fold chain structure exactly according to a predetermined scheme.

Continuing with the description of the automated manufacturing process, the sheet may then be advanced to the next stage of fabrication where mechanisms perform sheet folding and seam closure operations on one or several of the chain units. These completed units in turn are folded into the rigid form in the manner previously described for transforming the chain structure of FIG. 1 into the rigid structure of FIG. 3. These newly formed structural units are continuously added to the length of previously twisted (folded) structural assemblage ahead of it. As a result of this process, a long relatively narrow sheet of material is transformed in a rigid structure of the type shown in FIGS. 2, 3–5, 11 or any of the other structures producible according to this invention. The individual three-dimensional units comprising such structures might be permanently or temporarily attached together by means of adhesive bonding, pressure sensitive tape, or by pegs passing through the units. The structural assemblage thereby produced may be similar to that of FIG. 3 and have predetermined overall lengths. Such lengths or "logs" may be assembled into more complex structures such as those shown in FIGS. 6, 7, 8 and 9 or others. Bonded assemblages of numbers of these logs in generally parallel array may be used for and constructed in the form of structural panels, beams or columns.

Folded configurations of flexible chains may also be conveniently held together by the use of pegs inserted through pre-cut holes in the faces of the three-dimensional enclosed units. As shown in the sheet 140 of FIG. 22 having a folded line pattern similar to that of FIG. 12 in which $\sigma = \sigma_p$, one such hole 142 per triangular face 144 is located at its centroid. Thereafter, a chain, such as that of FIG. 1 is produced from sheet 140. Whatever the folded assembly formed from that chain, holes 142 will always line up in a precise manner, not only in one, but several directions. This permits insertion of pegs not only longitudinally, but also transversely to a generated direction of folding, the result being a three-dimensional locking of the assembly. Alternatively, as shown in FIG. 23, the sheet 140′ (similar in all respects to FIG. 22, except for the hole pattern) may have three holes 146 per triangular face 144′, each similarly positioned near the three vertices of the triangle of each face. This permits a firmer coupling of adjacent three-dimensional units. When drawn tight, the in-place pegs produce clamping forces between the tetrahedra and are effective to hold them for gluing adjacent units into a permanent assembly. The pegs in holes 146 being close and parallel to the edges, also serve to reinforce those edges of the prisms that result from folded chains having $\sigma = \sigma_p$.

By means of such pegs, (dowels, pins, wire, and the like, of various materials), any of the numerous complex assemblies of the folded chain may be held permanently or temporarily together. The inherent property of the chain structures of this invention, namely, that they can be produced from a flat sheet or strip, makes implementation of this feature very economical, since the holes can be punched into the flat sheet while the fold pattern is being embossed. The well-defined geometrical nature of these structures makes it possible to determine the exact desired positions of holes or hole patterns in the resulting flexible chain so that the holes line up in a sufficiently exact manner to permit easy insertion of pegs, even in large complex assemblies.

Figure 22:
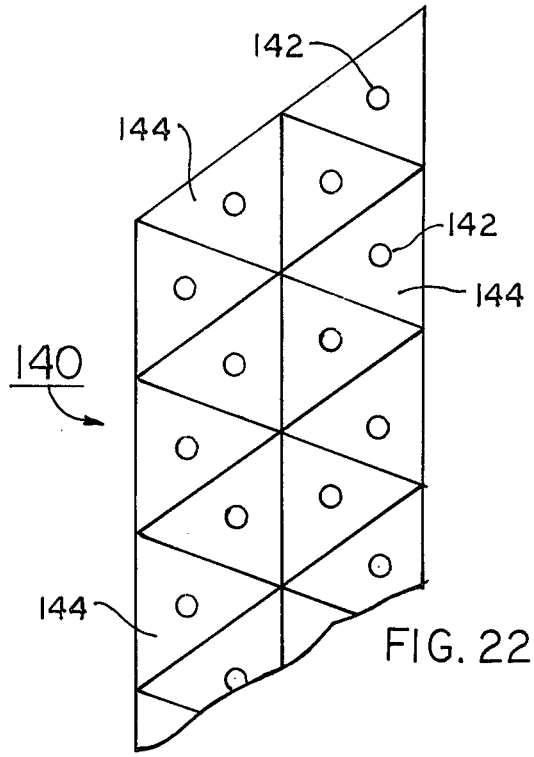
FIG. 22 is a face view of a fold line sheet similar to FIG. 12 and illustrating a hole pattern for retainers.
Figure 23:
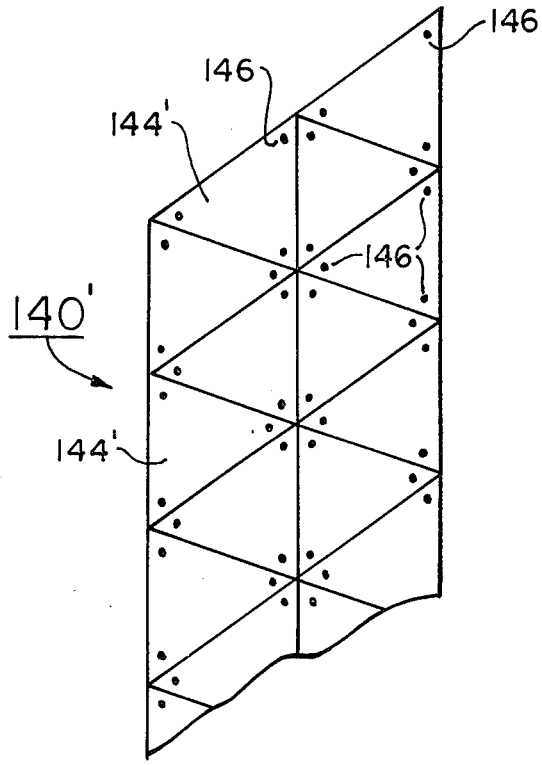
FIG. 23 is a face view similar to FIG. 22 and illustrating a modified hole pattern.

The use of pegs with a hole pattern of the FIG. 22 type is especially convenient for holding folded configurations of the flexible chains together temporarily. This technique permits the assemblage of a given chain structure in any of a possibly great variety of interesting folded configurations that can be produced from it. Pegs of different lengths can be employed to hold various units in folded relation as a configuration is being developed. The pegs can hold the entire finished assemblage together. If desired, an assemblage can be dismantled merely by withdrawing the pegs. By this means, a given chain structure may be assembled and and disassembled many times without damaging the units as would result were units held together by adhesive means.

The peg assembly technique facilitates the employment of flexible chains, especially of the type based on base angles $\sigma = \sigma_p$, as educational devices, puzzles, or toys. As is evident from the previous discussion of this invention, the great variety of folded configurations producible from such chains can be explored and studied conveniently by means of the peg assembly and disassembly technique.

A myriad of assemblages are in fact possible to construct from a given chain consisting of many three-dimensional units. A chain such as that shown in FIG. 1 but having, say, 30 tetrahedra can be assembled in tens of thousands of different configurations. Another interesting feature of employing such chain structures in this particular usage is that any one of the many possible assemblages can be constructed by following a simple recipe which describes the sequence of folding the units together, beginning from one end of the chain and proceeding toward the other end. The use of different colors or printed patterns on the faces of the various units can enhance the configurational variety and, hence, the entertainment and educational values that are obtainable.

Spring elements 150–153 (FIG. 1) can be attached at selected hinges in the chain structure in either a relaxed or preloaded condition. Where relaxed springs are so attached, for example, to a hinge (3,4) of chain structure 50 in FIG. 1 and adjacent three-dimensional units 51 and 52 are brought into a packing relation about that hinge, the spring will be loaded as a result. If such an assembly is then released from the forces which brought about its packing relation, it will self-unfold into the original configuration. When preloaded springs are, instead, so attached to a hinge location, adjacent units will self-fold into a packing relation. For example, if preloaded springs 150–153 are attached so as to act about hinge lines (3,4), (5,6), (7,8), (9,10), (11,12), (13,14) and (15,16) of structure 50 of FIG. 1 in such a direction as to bring corresponding pairs of faces 4, 3, 1 and 4, 3, 6, 5, 6, 3 and 5, 6, 8, 7, 8, 5 and 7, 8, 10, 9, 10, 7 and 9, 10, 12, etc. into mutual contact, the structure 50, when released from the external forces which resist the spring preloads, will self-fold into the structure 60 of FIG. 2. When, in addition, the ends of the latter structure are pulled apart, the structure will extend and if pulled sufficiently will extend to the original configuration 50. These springs are Z-shaped metallic wires (in one example) having tabs 154, 155 and torsional connecting element 156 respectively attached to the tetrahedra edges and hinge.

Such springs can be added to any chain structure embodied in this invention, as for instance those of FIGS. 14, 16 and 19. By proper arrangement of the position and twist direction of preloaded springs, chain structures can be made to form any one of a myriad of folded structures.

Springs may also be fastened to the flat sheets 92, 110, 114 and 124, respectively, of FIGS. 12, 13, 15 and 17 at corresponding hinge locations; either in the relaxed or preloaded condition. Wire torsional springs in the shape of a Z or U, or flexure-type springs applied at the hinges are particularly useful. If relaxed springs are so attached to the flat sheet, they will become loaded during the process of folding it into the chain structure, as for example during the process previously described for folding the sheet 92 of FIG. 12 into the structure 50 of FIG. 1. If preloaded springs are, instead, fastened to the flat sheet, they may become more loaded or less loaded when the sheet is folded into the chain structure. Attachment of such springs to the flat sheet provides an easy and economical method for producing chain structures containing springs.

Magnets may also be attached to the three-dimensional units or to their corresponding flat sheets to produce self-folding or self-unfolding chain structures as taught herein. Such magnets may be attached near the vertices that are opposite the chain hinges to produce similar rotational motions of adjacent three-dimensional units about the respective hinges as are produced by the above-described springs.

It is apparent from the foregoing description that a great variety of useful and interesting products can be produced according to the art taught in this invention. New and improved chain structural units are provided, as well as novel rigid structures that are foldable from hinged chain structures. In addition, novel foldable blanks of sheet material for forming chain structures are also provided.

While the foregoing has described what are at present considered to be the preferred embodiments of the invention, it will be apparent that various modifications and other embodiments within the scope of the invention will occur to those skilled in the art. Accordingly, it is desired that the scope of the invention be limited by the appended claims only.

What is claimed is:

1. A structure comprising a chain of three-dimensional enclosed units, each two adjacent ones of said units in the chain being connected by a hinge, the axis of said hinge being transverse to that of the chain; at each vertex of said chain, the face angles about said vertex summing substantially to 360°; said three-dimensional enclosed units having curved faces.

2. A blank sheet material for forming a chain of three-dimensional units characterized by;

a first set of parallel spaced fold lines formed for folding in one direction in said sheet, a second set of spaced fold lines formed for folding in the opposite direction in said sheet extending transversely to said first lines, and intersecting them at junctions, at least one third line formed for folding in said opposite direction in said material and intersecting said first and second lines at said junctions, said blank being bounded by longitudinal and transverse edges, said first set of lines extending parallel to said transverse edge, said third line extending parallel to said longitudinal edge and intersecting said first lines and transverse edge at the midpoints thereof, said first fold lines being straight, and said second and third fold lines being curved.

wherein a chain of three-dimensional units is formed by folding said sheet along said fold lines with the hinged connections of the three-dimensional units in the chain being along said first lines.

3. A blank of sheet material for forming a chain of three-dimensional units characterized by;

a first set of parallel spaced fold lines formed for folding in one direction in said sheet, a second set of spaced fold lines formed for folding in the opposite direction in said sheet extending transversely to said first lines, and intersecting them at junctions, at least one third line formed for folding in said opposite direction in said material and intersecting said first and second lines at said junctions, said blank being bounded by longitudinal and transverse edges, said first set of lines extending parallel to said transverse edge, said third line extending parallel to said longitudinal edge and intersecting said first lines and transverse edge at the midpoints thereof, and further comprising a fourth set of spaced fold lines extending parallel to said first fold lines and intersecting said second and third fold lines at other junctions, successive segments of each of said fourth fold lines between said other junctions being formed for folding alternately in said one and opposite direction, wherein a chain of three-dimensional units is formed by folding said sheet along said fold lines with the hinged connections of the three-dimensional units in the chain being along said first lines.

4. A structure comprising a chain of three-dimensional enclosed units, each two adjacent ones of said units in the chain being connected by a hinge, the axis of said hinge being transverse to that of the chain; said chain being formed from a sheet and at each vertex of said chain, the face angles about said vertex summing substantially to 360°; said three-dimensional enclosed units including faces having the forms of a triangle and a trapezoid.

5. A structure as recited in claim 4 wherein the faces of said three-dimensional enclosed units further include the form of a rectangle.

6. A folded rigid structure comprising a continuous chain of three or more three-dimensional units with successively adjacent units hinged generally along common linear edges and having faces proximate to said hinge edges, each of said units hinged to two other adjacent units in succession in said chain being folded at said common hinge edges against the adjacent units so that proximate faces thereof are in contact with the proximate faces of the adjacent units, whereby all of the successive units of the chain are stacked in a rigid assembly.

7. A folded rigid structure as recited in claim 6, wherein successive hinge edges are parallel.

8. A folded rigid structure as recited in claim 6, wherein said faces are curved.

9. A folded rigid structure as recited in claim 6, wherein said faces are trapezoidal.

10. A folded rigid structure as recited in claim 6, wherein successive hinge edges alternately extend in transverse direction, and said faces are triangular.

11. A folded rigid structure as recited in claim 10, wherein the folding follows a certain helical pattern.

12. A folded rigid structure as recited in claim 11, wherein alternate sections of the rigid assembly have opposite helical patterns.

13. A folded rigid structure as recited in claim 6, wherein said units include openings therein that are aligned in assembled form to receive retaining elements for holding said units in said rigid assembly.

14. A folded rigid structure as recited in claim 6, wherein at each vertex of said chain, the face angles about said vertex sum substantially to 360°.

15. A structure as in claim 6 wherein said three-dimensional enclosed units are hollow.

16. A structure as in claim 15 wherein said hinged units are folded from a sheet.

17. A structure as in claim 6 wherein said three-dimensional enclosed units are solid.

18. A structure as in claim 6 wherein said three-dimensional enclosed units have plane faces.

19. A folded structure as recited in claim 6 wherein said units have triangular faces.

20. A structure as in claim 19 wherein said triangular faces are isosceles.

21. A structure as in claim 19, wherein the sum of the base angles of said triangular faces is greater than 90° and less than 180°.

22. A folded structure as recited in claim 6 wherein said units are tetrahedra to form a crystalline structure.

23. A folded structure as recited in claim 6 wherein said tetrahedra have triangular faces with equal base angles whose tangents are approximately equal to $\sqrt{2}$ to form a prismatic structure.

* * * * *